US007426795B2

(12) United States Patent
Raddon

(10) Patent No.: US 7,426,795 B2
(45) Date of Patent: Sep. 23, 2008

(54) METHOD AND SYSTEM FOR REMOVING SNOW

(75) Inventor: Max L. Raddon, Sandy, UT (US)

(73) Assignee: Ron Raddon, Draper, UT (US)

( * ) Notice: Subject to any disclaimer, the term of this patent is extended or adjusted under 35 U.S.C. 154(b) by 369 days.

(21) Appl. No.: 11/090,619

(22) Filed: Mar. 25, 2005

(65) Prior Publication Data

US 2005/0246925 A1 Nov. 10, 2005

Related U.S. Application Data

(60) Provisional application No. 60/568,752, filed on May 6, 2004.

(51) Int. Cl.
*E01H 5/06* (2006.01)

(52) U.S. Cl. ..... 37/241; 37/264; 172/817

(58) Field of Classification Search ..... 37/233, 37/241, 264, 266, 274, 281; 172/811, 817
See application file for complete search history.

(56) References Cited

U.S. PATENT DOCUMENTS 2,262,415 A * 11/1941 Williams et al. ..... 172/777
2,413,467 A * 12/1946 Patterson ..... 172/297
2,455,692 A * 12/1948 McDunnah ..... 414/726
3,858,662 A * 1/1975 Reid ..... 172/297
4,890,400 A * 1/1990 Long ..... 37/241
5,088,215 A * 2/1992 Ciula ..... 37/197
5,615,745 A * 4/1997 Cross ..... 172/811
5,967,241 A * 10/1999 Cross et al. ..... 172/811
6,178,668 B1 * 1/2001 Gustafson et al. ..... 37/231
6,269,557 B1 * 8/2001 Henks ..... 37/235
6,295,892 B1 * 10/2001 Roy et al. ..... 74/532
6,334,269 B1 * 1/2002 Dilks ..... 37/235
6,502,334 B1 * 1/2003 Davies ..... 37/231
6,519,880 B2 * 2/2003 Robitaille ..... 37/231
6,964,121 B2 * 11/2005 Harris ..... 37/231
7,051,500 B2 * 5/2006 Martin ..... 56/14.9
7,219,453 B2 * 5/2007 Baker ..... 37/232

* cited by examiner

*Primary Examiner*—Gary S Hartmann
(74) *Attorney, Agent, or Firm*—Kirton & McConkie; Michael F. Krieger

(57) ABSTRACT

The present invention relates to a snowplow system. One embodiment of the present invention relates to a system for snowplowing with an all terrain vehicle. The system includes an all terrain vehicle, at least one control member, a latch, and a blade. The latch is configured to lock the blade at a particular horizontal rotational orientation. When the latch is released, the blade is coupled to the all terrain vehicle in a manner that allows for horizontal rotation. The at least one control member is coupled to the blade and positioned on the all terrain vehicle such that a user can horizontally rotate the blade from a sitting position on the all terrain vehicle. This allows a user to efficiently remove snow from an area.

17 Claims, 5 Drawing Sheets

METHOD AND SYSTEM FOR REMOVING SNOW

RELATED APPLICATIONS

This application claims priority to U.S. provisional application Ser. No. 60/568,752, filed May 6, 2004.

BACKGROUND

1. Field of the Invention

The present invention relates to snowplows. More particularly, the present invention relates to snowplow controllers that allow for convenient control of blades from the driving position of a snowplow.

2. Background of the Invention and Related Art

Snowplows are commonly used to effectively and efficiently remove snow from streets, driveways and sidewalks. Because of their effectiveness, smaller vehicles, such as all terrain vehicles (ATV's) have become increasingly used as snowplows. While much time and effort is saved by using ATVs as snowplows, there are still problems. For instance, existing snowplow devices adapted for use with an ATV are not easily adjustable. For example, when a user clears his/her driveway, he/she drives in one direction, pushing the snow to one side of the driveway. Before returning in the opposite direction, the user must first must get off of the ATV and pivot the snowplow so that the snow will be directed to the same side on the way back. This extra effort from the snowplow user is cumbersome, time-consuming and often uncomfortable, as the user must often clear snow away from the blade in order to manually adjust the snowplow.

Therefore, it is desirable to have a method and system that is simple and inexpensive to manufacture and easily mounted to existing ATV snowplows that facilitates the manual adjustability of such snowplows.

SUMMARY OF THE INVENTION

The present invention relates to a snowplow system. One embodiment of the present invention relates to a system for snowplowing with an all terrain vehicle. The system includes an all terrain vehicle, at least one control member, a latch, and a blade. The latch is configured to lock the blade at a particular horizontal rotational orientation. When the latch is released, the blade is coupled to the all terrain vehicle in a manner that allows for horizontal rotation. The at least one control member is coupled to the blade and positioned on the all terrain vehicle such that a user can horizontally rotate the blade from a sitting position on the all terrain vehicle. This allows a user to efficiently remove snow from an area.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The present invention relates to a snowplow system. One embodiment of the present invention relates to a system for snowplowing with an all terrain vehicle. The system includes an all terrain vehicle, at least one control member, a latch, and a blade. The latch is configured to lock the blade at a particular horizontal rotational orientation. When the latch is released, the blade is coupled to the all terrain vehicle in a manner that allows for horizontal rotation. The at least one control member is coupled to the blade and positioned on the all terrain vehicle such that a user can horizontally rotate the blade from a sitting position on the all terrain vehicle. This allows a user to efficiently remove snow from an area. While embodiments of the present invention are directed at snowplows, it will be appreciated that the teachings of the present invention are applicable to other areas.

As used in this specification, the following terms are defined accordingly:

- "all terrain vehicle" is any vehicle capable of operating on both paved and unpaved surfaces including but not limited to golf carts, ATVs, ATCs, motorcycles, tricycles, etc.
- "control member" is any type of rigid or flexible member that is coupled to the blade and extends to the ATV such that a user can control the horizontal rotatation of the blade from the seat of the ATV.
- "latch" is any mechanism that is capably of releasably locking the blade in a particular horizontal rotational orientation.
- "horizontal rotation" is a type of rotation in which an item rotates in a horizontal plane while substantially maintaining a particular height.

Figure 1:
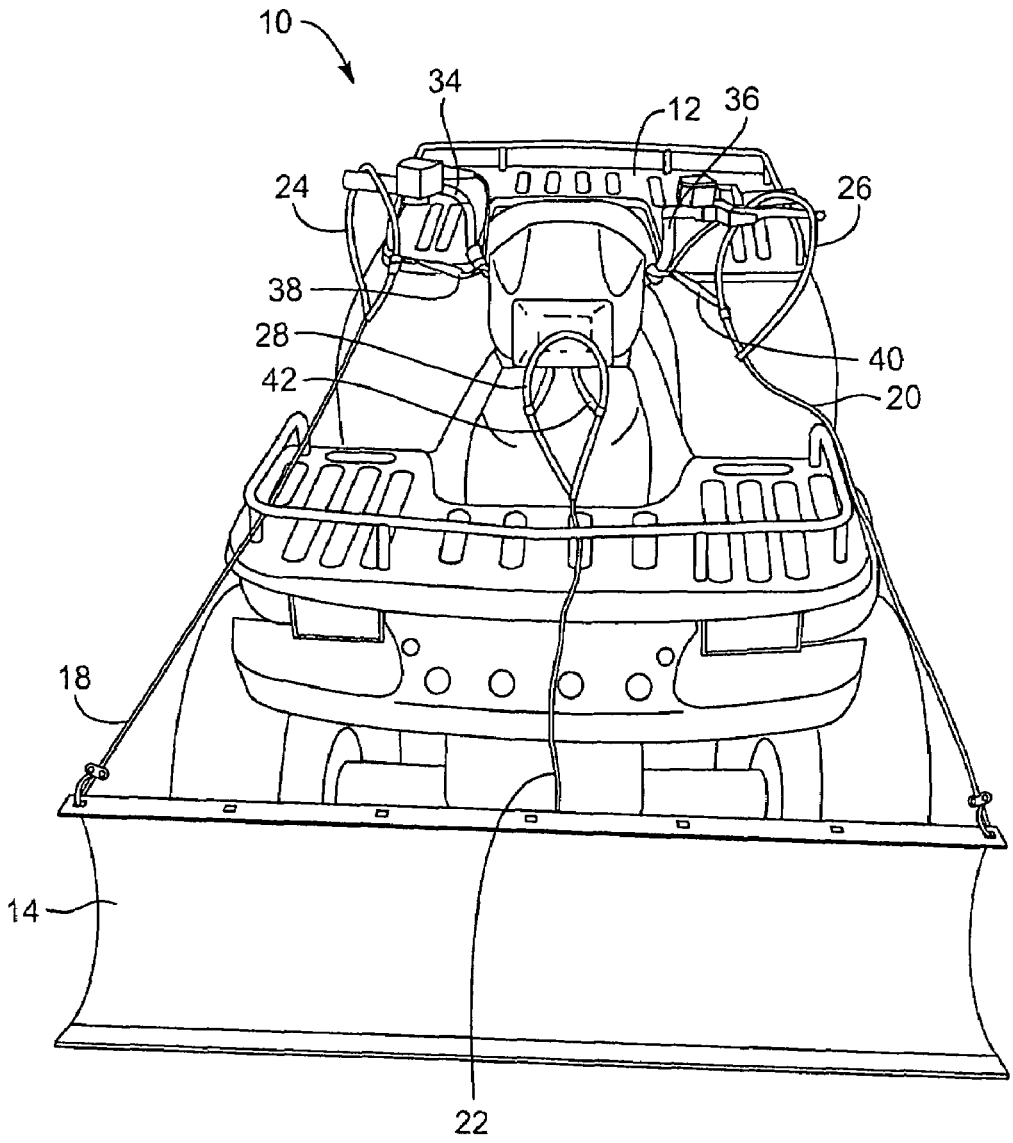
FIG. 1 illustrates a front view of a snowplow system in accordance with the present invention.

Reference is initially made to FIG. 1, which illustrates a front view of a snowplow system in accordance with the present invention. The system is designated generally at 10. The system 10 generally includes an ATV 12, a blade 14 and a plurality of control members or reins. The illustrated ATV 12 is a standard four wheel motorized device used for a variety of applications. Alternatively the system may be utilized in conjunction with another type of all terrain vehicle including but not limited to a golf cart, a ATC, a tricycle, a motorcycle, etc. Therefore, the specific type of all terrain vehicle is not imperative for the operation of the present invention. Likewise, the blade 14 may be any blade capable of displacing snow. While, the illustrated blade 14 includes a vertical curvature, any shape may be utilized including but not limited to a wedge, a slant, a flat plate, multiple curvatures, etc.

The illustrated control members include a plurality of flexible reins 18, 20, 22 and handles 24, 26, 28. The reins are designated individually as a first rein 18, a second rein 20, and a center rein 22. The handles are designated individually as a first rein handle 24, a second rein handle 26, and a center rein handle 28. The first rein 18 and second rein 20 are coupled to the blade 14 as illustrated. The center rein 22 is coupled to a latch 30 (Illustrated in FIG. 3 and 4). The latch 30 is configured to operate in two positions, a released/engaged position in which the blade 14 is free to horizontally rotate and a fixed position in which the blade is restricted from horizontal rotation. When the latch 30 is in the engaged position, the blade 14 is able horizontally rotate or pivot. When latch 30 is in a fixed or non-engaged position, the blade 14 is fixed in a particular horizontal rotational position.

Figure 2:
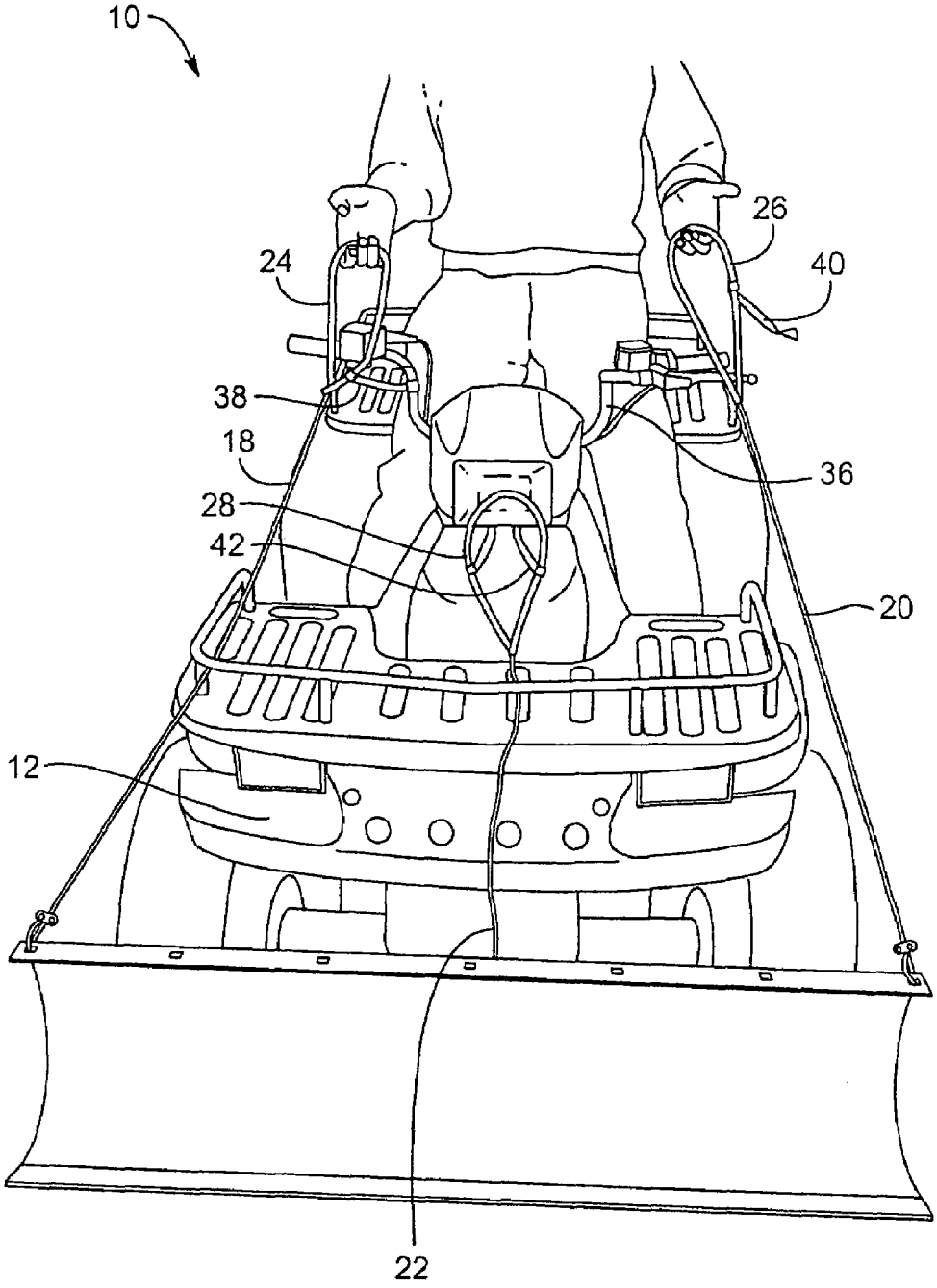
FIG. 2 provides an additional illustration of a front view of the snowplow system illustrated in FIG. 1.

FIG. 1 illustrates the snowplow reins 18, 20, 22 in a resting configuration. In this configuration, the snowplow reins 18, 20, 22 are positioned to allow a user to drive the ATV 12 without being hindered by the attached snowplow reins 16. The first rein handle 24 and second rein handles 26 are attached to the ATV 12 in two ways. First, the first rein handle 24 and second rein handles 26 are firmly attached to a first ATV handlebar 34 and a second ATV handlebar 36 respectively. The first rein handle 24 and second rein handle 26 are firmly attached to first ATV handlebar 34 and second ATV handlebar 36 via a first rubber attachment 38 and a second rubber attachment 40. As shown in FIG. 2, the flexibility of the rubber attachments 38, 40 enable a user to more easily grasp the rein handles 24, 26 and manipulate them in order to manually pivot blade 14. Alternatively or in addition, the first rein handle 24 and second rein handle 26 are attached to the ATV 12 by hooking the rein handles 24, 26 around the ATV handlebars 34, 36 as shown. The center rein handle 28 is attached to ATV 12 by a center rubber attachment 42. The rubber attachments 38, 40, 42 elastically secure the rein handles 24, 26, 22 to a particular location to facilitate their efficient use.

Reference is next made to FIG. 2, which illustrates a second frontal view of the system 10. In particular, FIG. 2 illustrates that the rubber attachments 38, 40 are removably coupled to the handlebars 34, 36. In the illustrated embodiment, the second rubber attachment 40 is not attached to second ATV handlebar 36, while first rubber attachment 38 is still firmly attached. A user may selectively detach one or both rubber attachments 38, 40 in order to facilitate more movement of the reins 18, 20 without the resistance of the rubber attachments 38, 40. Alternatively, a user may detach the rubber attachments 38, 40 from the handlebars 34, 36 in order to manually hook the rein handles 24, 26 over the handlebars 34, 36.

Thus, the present invention, as shown in FIGS. 1 and 2 allows a user to operate the ATV 12 to displace snow while also enabling the user to manipulate the snowplow reins 18, 20, 22 in order to pivot the blade 14 without forcing the user to dismount from the ATV 12. This system 10 increases the speed with which a user can clear snow from a walkway because the user is able to easily reconfigure the blade 14 and operate the ATV 12 from the same location. In addition, the process of clearing snow is safer for the user because they do not have to spend extra time walking on icy or snowy ground.

Figure 3:
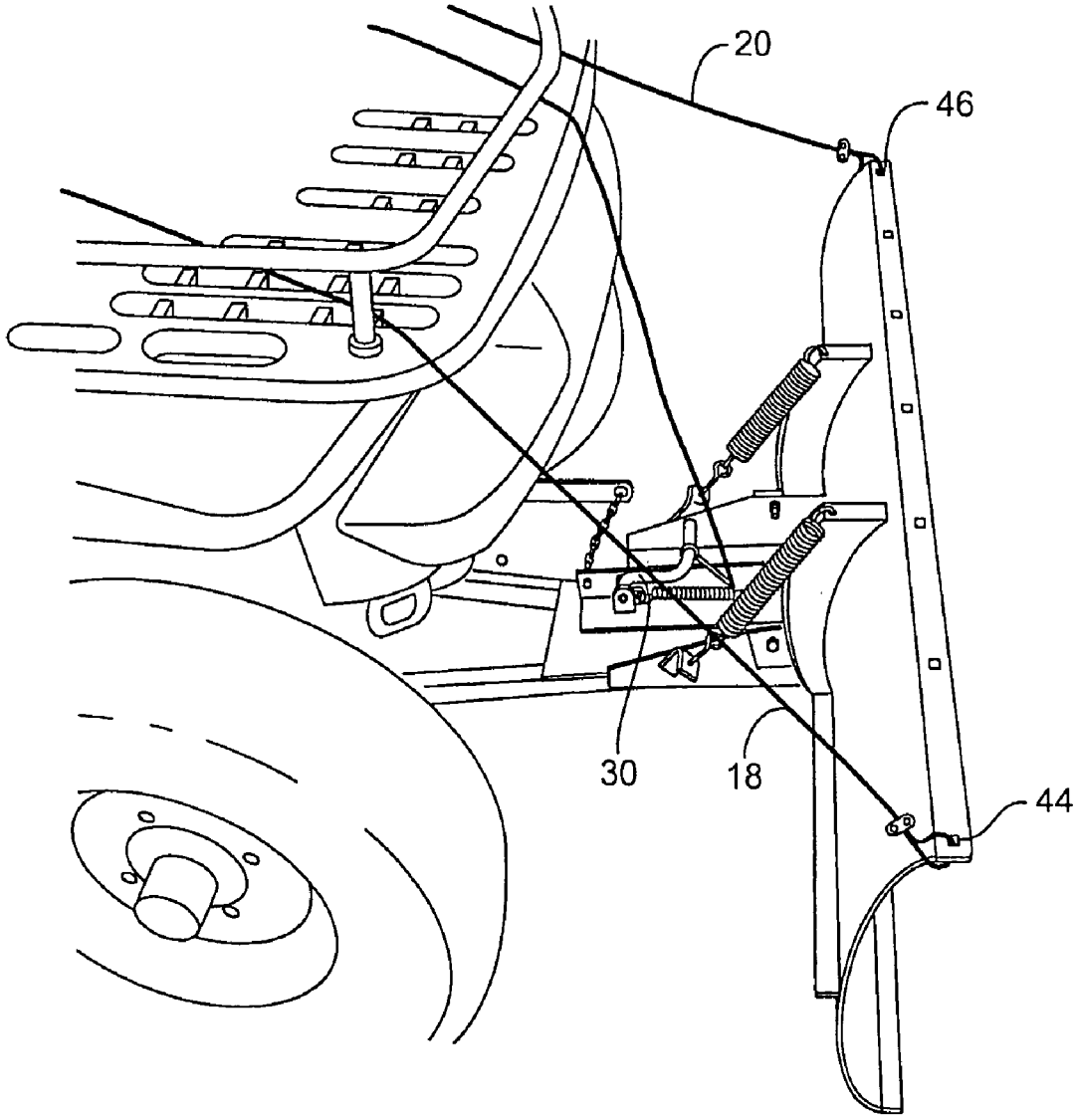
FIG. 3 illustrates a profile view of the system illustrated in FIG. 1.

Reference is next made to FIG. 3, which illustrates a profile view of the system illustrated in FIG. 1. In particular, FIG. 3 illustrates how the snowplow reins 18, 20, 22 are connected to the blade 14. The first rein 18 is coupled to blade 14 via a first hole 44 located on the upper left corner of the blade 14. The second rein 20 is attached to the blade 14 via a second hole 46 located in the upper right corner of the blade 14. While this embodiment shows snowplow reins made out of a rope-like material, other materials well known to one skilled in the art could also easily be used and remain consistent with the present invention. While this embodiment shows a first hole 44 and a second hole 46 as the primary means by which snowplow reins 16 are attached to the blade 14, other attachment configurations may be used and remain consistent with the invention.

Figure 4:
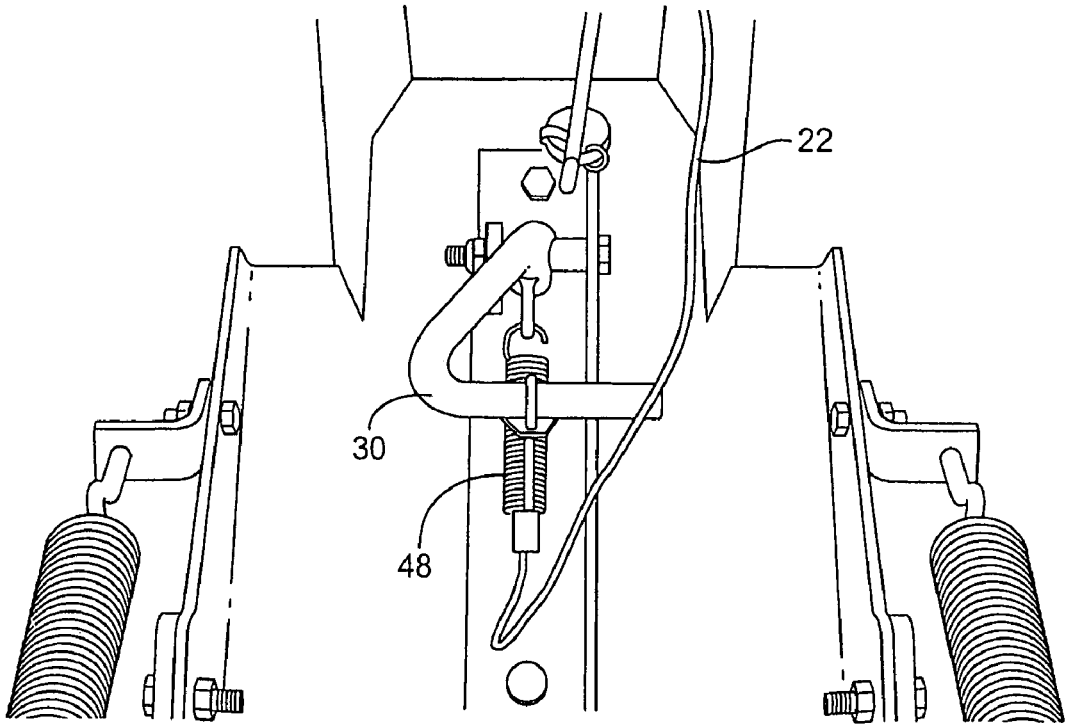
FIG. 4 illustrates a detailed view of the latch illustrated in FIG. 3.

Reference is next made to FIG. 4, which illustrates a detailed view of the latch 30 illustrated in FIG. 3. The latch 30 is engaged when a user exerts pulls on the center rein 22. The resulting force engages the latch 30 and allows the user to horizontally rotate/pivot the blade 14 with the first and second reins 18, 20. In the illustrated embodiment, a spring 48 is used in biasing the latch in the locked position.

Figure 5:
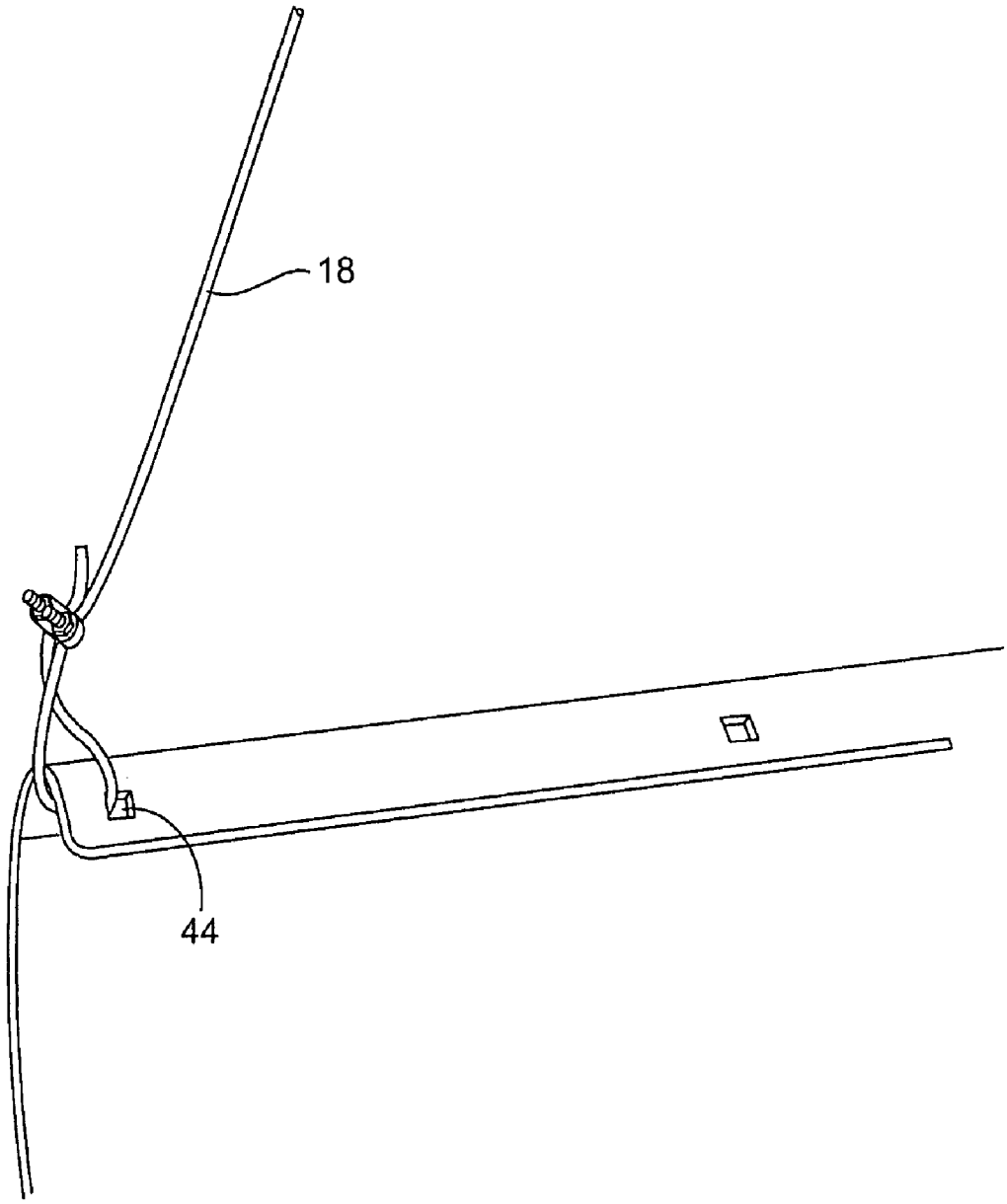
FIG. 5 illustrates a detailed view of a first hole on the blade illustrated in FIG. 1.

Reference is next made to FIG. 5, which illustrates a detailed view of the first rein 18 and the first hole 44. The first rein 18 is looped through the first hole 44 and attached to itself with a compression device to create a firm connection between the first rein 18 and the blade 14. Various connection systems may be utilized and remain consistent with the present invention. This same attachment system may also be employed for the second rein 20 and the second hole 46.

Thus, as discussed herein, the embodiment of the present invention embraces an improved system and method for pivoting a blade, where the user does not have to dismount in order to pivot the blade. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by Letters Patent is:

1. A snowplow system comprising:

an all terrain vehicle comprising a first handlebar and a second handlebar;

a blade coupled to the all terrain vehicle in a manner to allow for horizontal rotation during vehicular operation;

a latch coupled to the all terrain vehicle and the blade, wherein the latch is configured to selectively lock the blade in a particular horizontal rotational location; and a first control member extending between the blade and the first handlebar, wherein a distal end of the first control member is coupled to the blade and a proximal end of the first control member is removably coupled to the first handlebar of the all terrain vehicle such that a user can horizontally rotate the blade without dismounting the all terrain vehicle by applying force to the proximal end of the first control member proximate the first handlebar, selectively uncoupling the first control member from the first handlebar as necessary.

2. The system of claim 1, wherein the all terrain vehicle includes four wheels.

3. The system of claim 1, wherein the blade includes a vertical curvature.

4. The system of claim 1, wherein the latch includes a release member that is coupled to the latch and wherein the release member extends from the latch to a release member handle positioned proximate the handlebars of the all terrain vehicle.

5. The system of claim 4, wherein upon exerting a pulling force onto the release member, the release member is configured to release the latch and allow the user to horizontally rotate the blade.

6. The system of claim 1, wherein the latch includes spring biasing mechanism.

7. The system of claim 1, wherein the first control member allows a user to horizontally rotate the blade by exerting a pulling force on a handle coupled to the first control member.

8. The system of claim 1, further comprising a second control member extending between the blade and the second handlebar wherein a distal end of the second control member is coupled to the blade at a location distal the first control member and a proximal end of the second control member is removably coupled to the second handlebar of the all terrain vehicle such that a user can horizontally rotate the blade without dismounting the all terrain vehicle by applying force to the proximal end of the second control member proximate the second handlebar, selectively uncoupling the second control member from the second handlebar as necessary.

9. The system of claim 1, wherein the first control member includes one flexible rein.

10. The system of claim 1, wherein the first control member is rigid.

11. A snowplow system comprising:

an all terrain vehicle comprising a first handlebar and a second handlebar;

a blade coupled to the all terrain vehicle in a manner to allow for horizontal rotation during vehicular operation;

a latch coupled to the all terrain vehicle and the blade, wherein the latch is configured to selectively lock the blade in a particular horizontal rotational location; and a first control member having a distal end coupled to the blade and a proximal end removably coupled to the first handlebar of the all terrain vehicle such that a user may horizontally rotate the blade without dismounting the all terrain vehicle by applying force to the first control member at the proximal end of the first control member.

12. The system of claim 11, further comprising a first control member handle coupled to the proximal end of the first control member.

13. The system of claim 11, further comprising a second control member having a distal end coupled to the blade and a proximal end removably coupled to the second handlebar of the all terrain vehicle such that a user may also horizontally rotate the blade without dismounting the all terrain vehicle by applying force to the second control member at the proximal end of the second control member.

14. The system of claim 13, further comprising first and second control member handles coupled to the proximal ends of the first and second control members, respectively.

15. The system of claim 14, further comprising:

a first flexible attachment attached to the first control member handle and removably coupled to the first handlebar; and a second flexible attachment attached to the second control member handle and removably coupled to the second handlebar.

16. The system of claim 14, further comprising:

a first flexible attachment attached to the first control member handle and removably coupled to the all terrain vehicle proximate the first handlebar; and a second flexible attachment attached to the second control member handle and removably coupled to the all terrain vehicle proximate the second handlebar.

17. The system of claim 11, wherein the first control member is rigid.

* * * * *